US010868399B2

(12) United States Patent
Joo et al.

(10) Patent No.: US 10,868,399 B2
(45) Date of Patent: Dec. 15, 2020

(54) ADAPTER

(71) Applicant: SAMSUNG ELECTRONICS CO., LTD., Suwon-si (KR)

(72) Inventors: Sung Yong Joo, Suwon-si (KR); Tae Jun You, Suwon-si (KR); Seong Ho Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/532,865

(22) Filed: Aug. 6, 2019

(65) Prior Publication Data

US 2020/0059052 A1 Feb. 20, 2020

(30) Foreign Application Priority Data

Aug. 16, 2018 (KR) ..... 10-2018-0095314

(51) Int. Cl.
*H01R 31/06* (2006.01)
*H01R 13/631* (2006.01)

(52) U.S. Cl.
CPC ..... *H01R 31/06* (2013.01); *H01R 13/631* (2013.01)

(58) Field of Classification Search
CPC ..... H01R 31/06; H01R 31/065
See application file for complete search history.

(56) References Cited

U.S. PATENT DOCUMENTS 5,634,806 A 6/1997 Hahn
8,398,430 B1 3/2013 Queru
8,408,924 B1 4/2013 Queru
8,579,641 B1 * 11/2013 Queru ..... H01R 33/7671 439/224
9,543,704 B1 1/2017 Hsu et al.
2011/0039435 A1 2/2011 Huang
2012/0289073 A1 11/2012 Wu et al.

FOREIGN PATENT DOCUMENTS

EP 2988377 A1 2/2016
JP 05-055469 U 7/1993
KR 10-2011-0080759 7/2011

OTHER PUBLICATIONS

Search Report and Written Opinion dated Nov. 22, 2019 in counterpart International Patent Application No. PCT/KR2019/009685.
Extended Search Report and Written Opinion dated Feb. 1, 2020 in European Patent Application No. EP19191338.3.
Chinese Office Action dated Aug. 5, 2020 for CN Application No. 201910756896.9.

* cited by examiner

*Primary Examiner* — Ross N Gushi
(74) *Attorney, Agent, or Firm* — Nixon & Vanderhye P.C.

(57) ABSTRACT

Disclosed herein is an adapter having a plug removably coupled to an adapter body. The adapter includes an adapter body including an adapter pin, a mounting portion provided in the adapter body and including a first mounting portion provided on one side of the adapter body on which the adapter pin is disposed, and a second mounting portion provided on another side of the adapter body, and a plug configured to be removably coupled to the first mounting portion and the second mounting portion wherein a plug terminal provided on one side surface of the plug is electrically connected to the adapter pin provided on the one side of the first mounting portion regardless of an orientation of the plug with respect to the mounting portion.

17 Claims, 11 Drawing Sheets

ADAPTER

CROSS-REFERENCE TO RELATED APPLICATION

This application is based on and claims priority under 35 U.S.C. § 119 to Korean Patent Application No. 10-2018-0095314, filed on Aug. 16, 2018, in the Korean Intellectual Property Office, the disclosure of which is incorporated by reference herein in its entirety.

BACKGROUND

1. Field

The disclosure relates to an adapter including a plug removably coupled to a body.

2. Description of Related Art

In general, electronic devices use different voltages depending on its type and usage, and have different shaped input devices, to which power is supplied, according to each electronic device.

Accordingly, in order to supply power to the electronic device, it is necessary to provide an appropriate voltage power source for use in the electronic device through a connector having a shape suitable for the input device, which is performed by an adapter corresponding to a power conversion supply device.

Particularly, an adapter is widely used as a device for converting AC power into DC power and supplying it to various electronic devices such as a notebook PC, a PC monitor, a display monitor, and a mobile phone using a DC power source.

In addition, the adapter is used as a device for charging a battery or supplying power necessary for driving an electronic device, and for generating an output power from an input power source.

Such an adapter is provided with a body in which an AC/DC converter and transformer is embedded, a plug connected to a power outlet, and a connector connected to an electronic device. Therefore, the adapter converts high voltage AC power into appropriate voltage DC power and supplies the appropriate voltage DC power to the electronic device.

Because the body of the adapter has a substantially rectangular parallelepiped shape, an external impact may be easily applied to the adapter due to the protruding body when the adapter is inserted into a power outlet on the wall. Further, when the adapter is inserted into a power strip with multi outlets, the usage of the adapter may be limited due to the interference of adapters or plugs placed in adjacent outlets.

SUMMARY

Various example embodiments of the present disclosure provide an adapter capable of reducing the interference with other adjacent adapters or plugs upon being inserted into a power outlet.

Various example embodiments of the present disclosure also provide an adapter having a plug removably coupled to a body.

Various example embodiments of the present disclosure provide an adapter capable of allowing an adapter body and a plug to be easily coupled to each other and separated from each other, by having a guide and a fixing portion.

Additional aspects of the present disclosure will be set forth in part in the description which follows and, in part, will be apparent from the description.

In accordance with an example aspect of the disclosure, an adapter comprises an adapter body including an adapter pin, a mounting portion provided in the adapter body and including a first mounting portion provided on one side of the adapter body on which the adapter pin is disposed, a second mounting portion provided on another side of the adapter body, and a plug configured to be removably coupled to the first mounting portion and the second mounting portion wherein a plug terminal provided on one side surface of the plug is electrically connected to the adapter pin provided on the one side of the first mounting portion regardless of an orientation of the plug with respect to the mounting portion.

The plug may be configured to be mounted on the mounting portion such that the plug terminal is disposed on one of the first mounting portion and the second mounting portion.

The plug may further include a plug body including a first plug body on which the plug terminal is disposed, and a second plug body extending from the first plug body in a direction different from a direction in which the first plug body extends.

The plug may include a socket including a first socket provided on one side of the first plug body and configured to allow the adapter pin to be inserted into the first socket, and a second socket disposed in the second plug body.

The first socket may be electrically connected to the second socket through a connecting member.

The socket may include a connecting portion coupled to the connecting member and an elastic portion extending from the connecting portion and configured to elastically fix the adapter pin.

The plug body may include an insertion portion including a first insertion portion provided in the first plug body and configured to allow the adapter pin to pass through the first insertion portion and to be inserted into the first socket, and a second insertion portion provided in the second plug body and configured to allow the adapter pin to pass through the second insertion portion and to be inserted into the second socket.

The adapter may further include a guide including a first guide provided in the adapter body and configured to guide the plug to be coupled to the adapter body, and a second guide provided in the plug and configured to be removably coupled to the first guide.

The mounting portion may further include a mounting surface including a pinhole through which the adapter pin passes, a support surface bent from the mounting surface and configured to support the plug, and a guide surface bent from the mounting surface and the support surface, wherein the guide is provided on the guide surface.

The first guide may include a guide protrusion protruding from the guide surface, and the second guide may include a guide groove provided at one end of the plug and configured to be coupled to the guide protrusion.

The adapter may further include a fixing portion including a first fixing portion provided in the adapter body and configured to removably fix the plug to the adapter body, and a second fixing portion provided in the plug and configured to be coupled to the first fixing portion.

The first fixing portion may include a button disposed in the adapter body and a locking portion configured to be coupled to and separated from the second fixing portion by being moved by the button, and the second fixing portion may include a locking groove wherein the locking portion is insertable into the groove.

The locking portion may be provided in one of the first mounting portion and the second mounting portion, and the locking groove may be provided in the first plug body and the second plug body, respectively.

The connecting member may include a pair of connecting members, and the plug may further include a noise filter connected between the pair of connecting members and configured to reduce noise generated in an electronic device connected to the adapter, from being conducted to the outside.

In order that the guide protrusion is fixed to the guide groove, the guide protrusion may have a width that increases along a length of the guide protrusion toward the mounting surface.

In accordance with another example aspect of the disclosure, an adapter includes an adapter body including an adapter pin, a mounting portion provided in the adapter body and including a first mounting portion on which the adapter pin is disposed, and a second mounting portion extending from the first mounting portion in a direction different from a direction in which the first mounting portion extends, a plug configured to be removably coupled to the mounting portion and configured to allow a plug terminal to be disposed on one of the first mounting portion and the second mounting portion, and a fixing portion including a first fixing portion provided in the adapter body and configured to fix the plug to the adapter body, and a second fixing portion provided in the plug and configured to be coupled to the first fixing portion.

The adapter may further include a guide including a first guide provided in the adapter body and configured to guide the plug to be coupled to the adapter body, and a second guide provided in the plug and configured to be coupled to the first guide in a sliding manner.

The plug may include a plug body including a first plug body on which the plug terminal is disposed, and a second plug body extending from the first plug body in a direction different from a direction in which the first plug body extends, wherein the plug may be mounted to the mounting portion of the adapter body such that a corner of the adapter body is arranged between the first plug body and the second plug body.

In accordance with another example aspect of the disclosure, an adapter includes an adapter body including an adapter pin, a plug configured to be removably coupled to the adapter body and including a plug body having a first plug body on which a plug terminal is disposed, and a second plug body extending from the first plug body in a direction different from a direction in which the first plug body extends, and a mounting portion provided in the adapter body and including a first mounting portion on which the adapter pin is disposed, and a second mounting portion extending from the first mounting portion in a direction different from a direction in which the first mounting portion extends, wherein the plug further includes a socket into which the adapter pin is inserted so that the plug terminal is disposed on one of the first mounting portion and the second portion is electrically connected to the adapter pin, the socket including a first socket provided in the first plug body and a second socket provided in the second plug body.

The plug terminal may include a power cord provided in the plug body.

BRIEF DESCRIPTION OF THE DRAWINGS

The above and/or other aspects, features and advantages of various example embodiments of the present disclosure will become apparent and more readily appreciated from the following detailed description, taken in conjunction with the accompanying drawings, in which.

DETAILED DESCRIPTION

Figure 1:
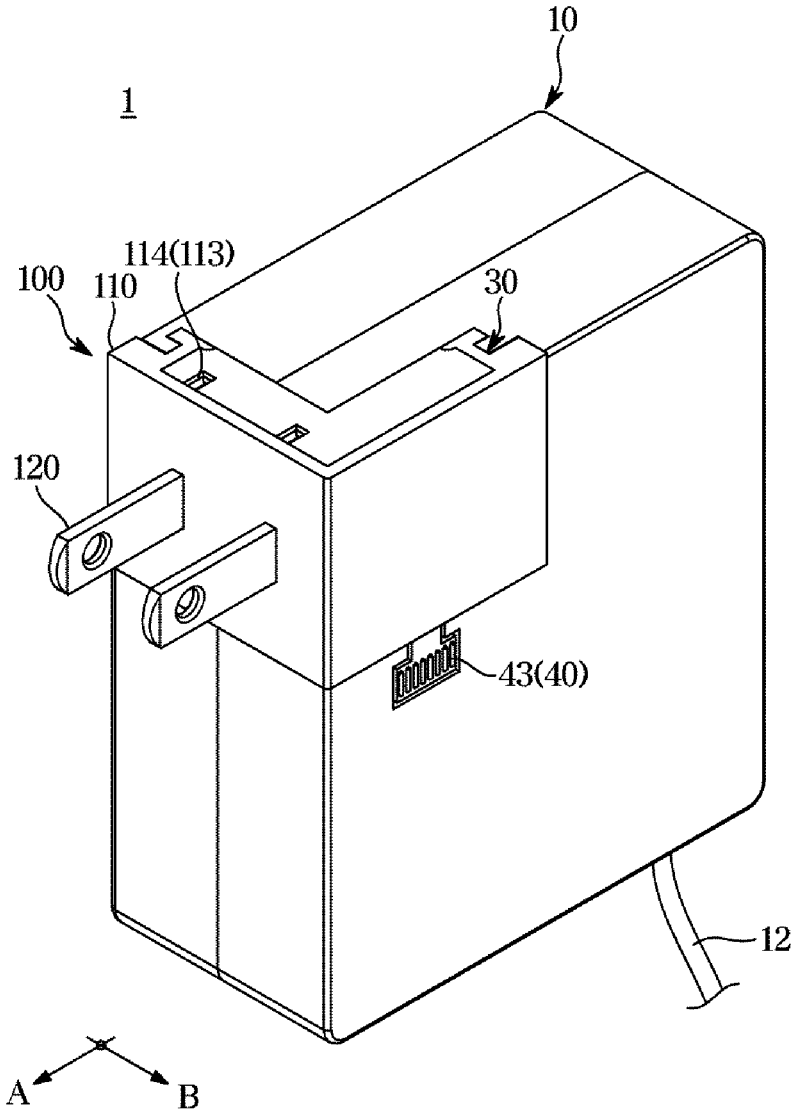
FIG. 1 is a perspective view illustrating an example adapter according to an embodiment of the disclosure.

Example embodiments described in the disclosure and configurations illustrated in the drawings are merely examples of the various example embodiments of the disclosure, and may be modified in various different ways at the time of filing of the present application to replace the embodiments and drawings of the present disclosure.

In addition, the same reference numerals or signs shown in the drawings of the disclosure indicate elements or components performing substantially the same function.

The terms used herein are used to describe the embodiments and are not intended to limit and/or restrict the disclosure. The singular forms "a," "an" and "the" are intended to include the plural forms as well, unless the context clearly indicates otherwise.

In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, the elements are not limited by these terms. These terms are only used to distinguish one element from another element.

For example, without departing from the scope of the present disclosure, a first element may be termed as a second element, and a second element may be termed as a first element. The term of "and/or" includes a plurality of combinations of relevant items or any one item among a plurality of relevant items.

In the following detailed description, the terms of "front, "rear", "upper portion", "lower portion", "upper end", "lower end" and the like may be illustrated in the drawings, but the shape and the location of the component is not limited by the term.

Figure 2:
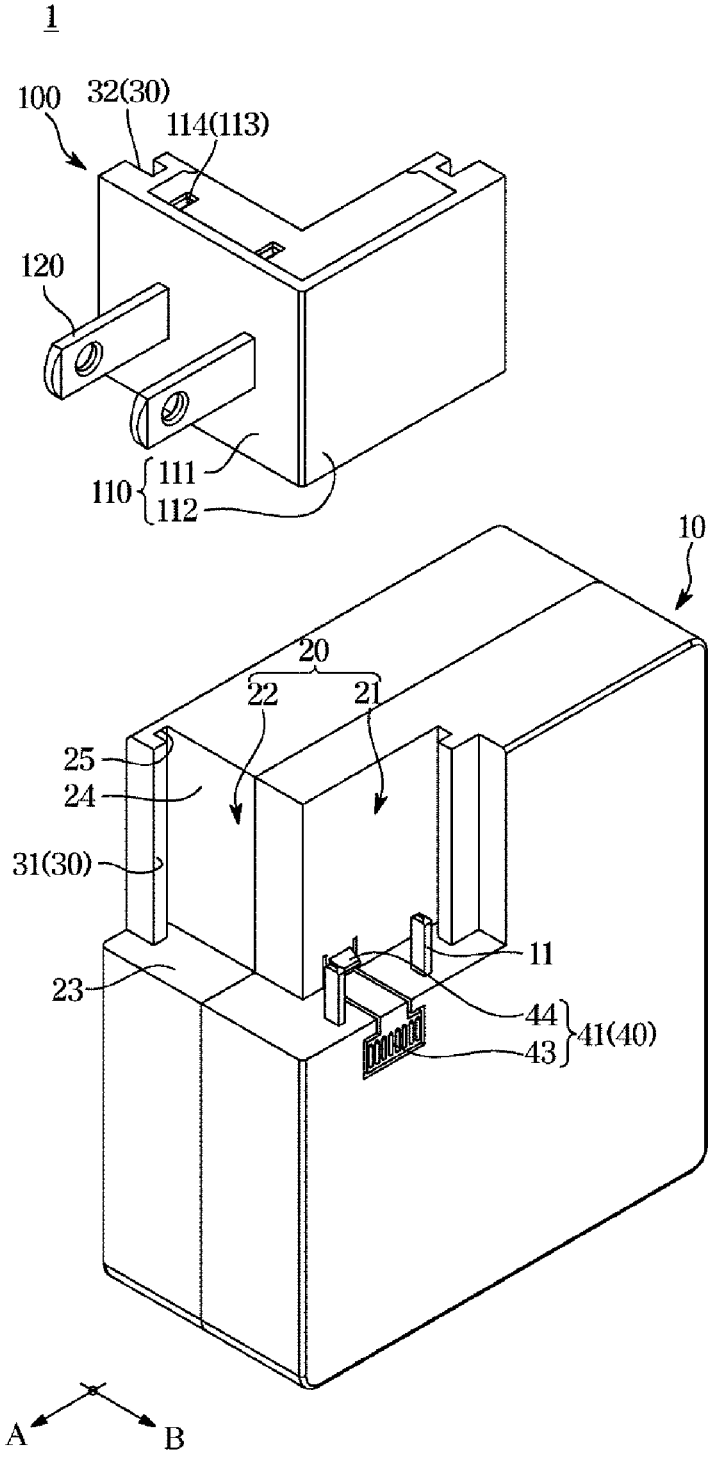
FIG. 2 is a diagram illustrating a state in which a plug is separated from a body to allow a plug terminal to be directed to a first direction, in the example adapter according to an embodiment of the disclosure.
Figure 3:
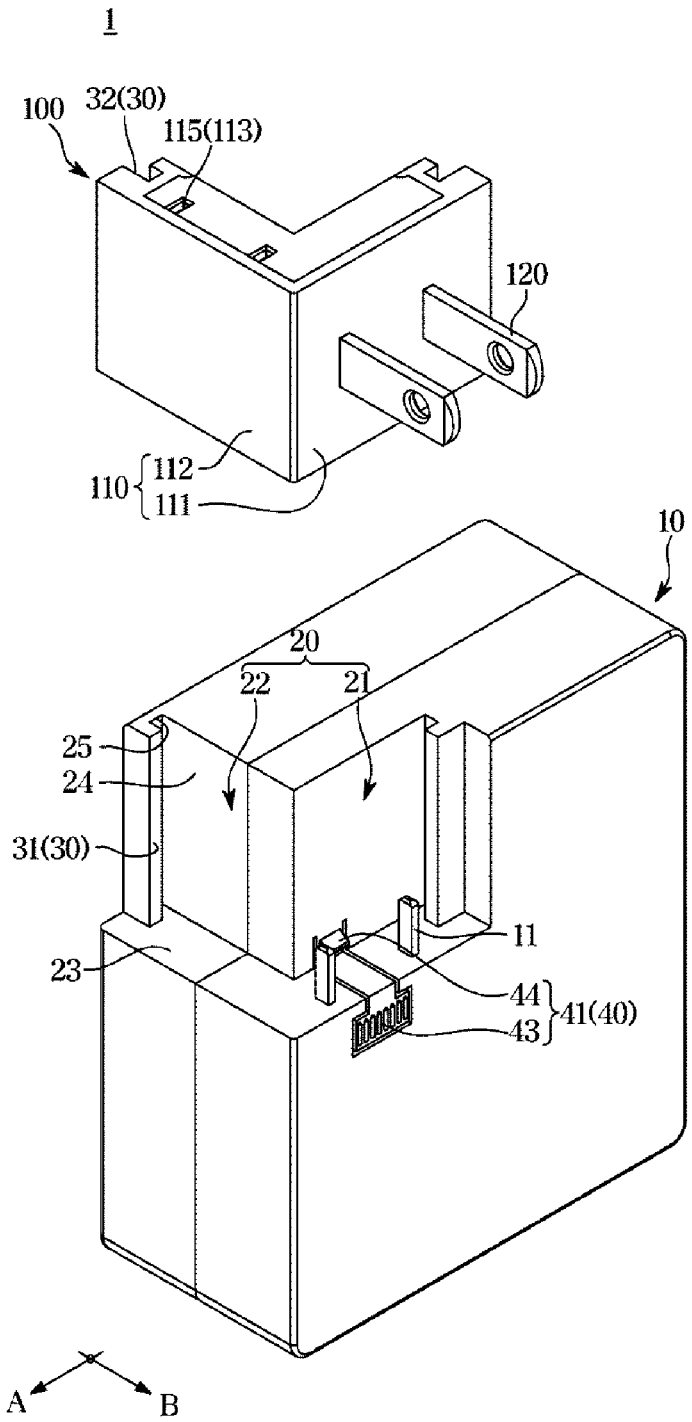
FIG. 3 is a diagram illustrating a state in which the plug is separated from the body to allow the plug terminal to be directed to a second direction, in the example adapter according to an embodiment of the disclosure.
Figure 4:
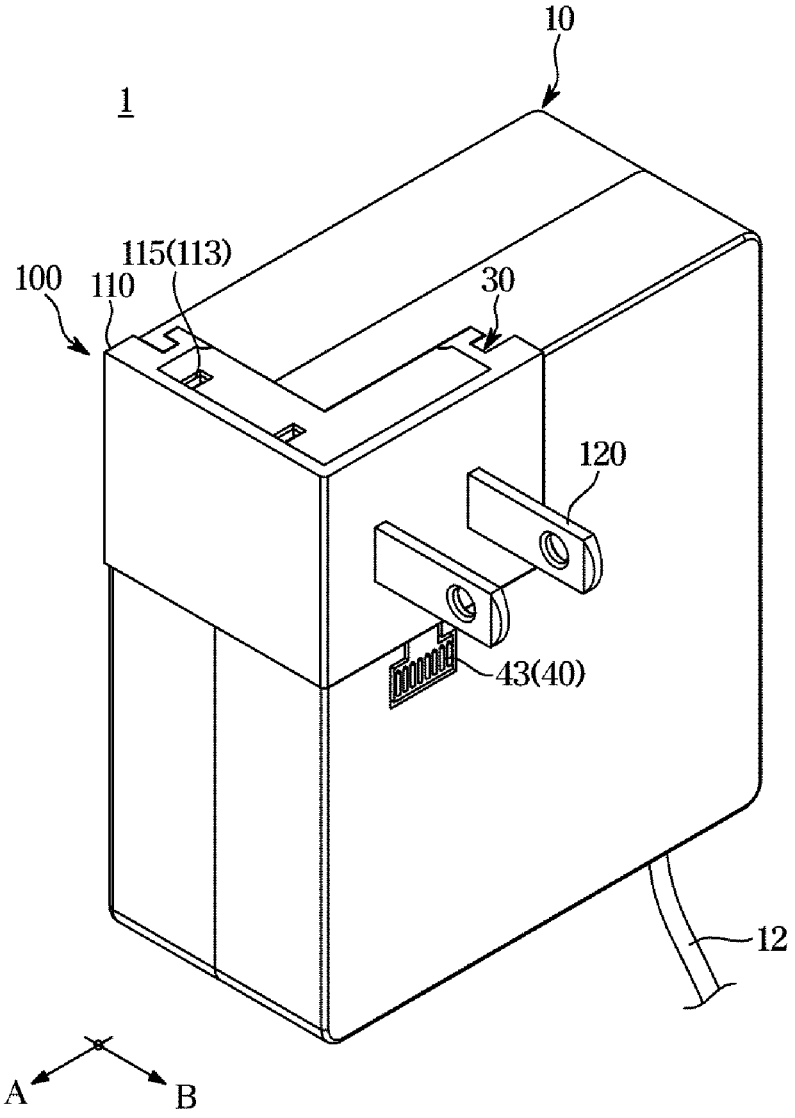
FIG. 4 is a perspective view illustrating a state in which the plug is coupled to the body to allow the plug terminal to be directed in the second direction, in the example adapter according to an embodiment of the disclosure.
Figure 5:
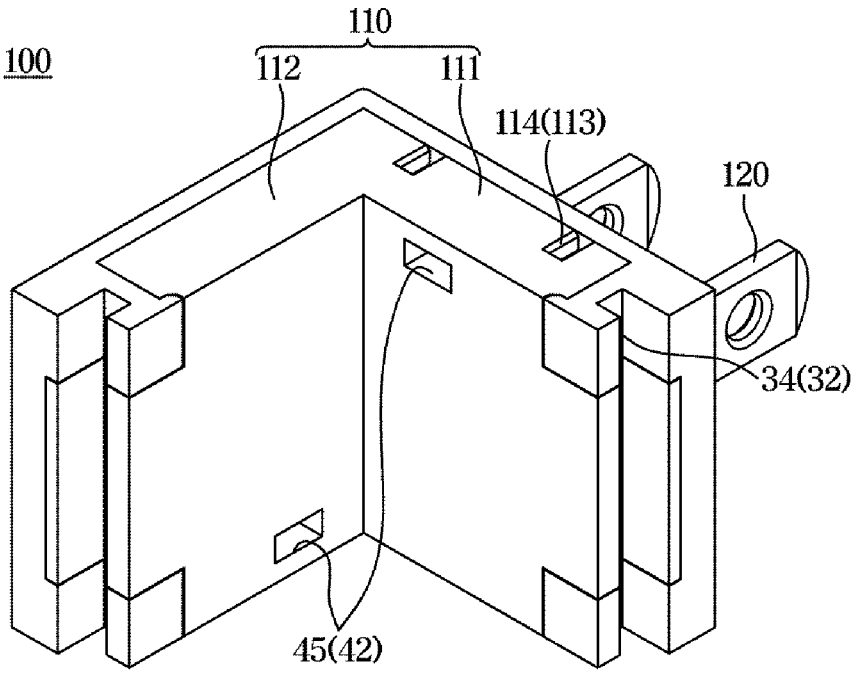
FIG. 5 is a diagram illustrating the plug of the example adapter according to an embodiment of the disclosure.

The disclosure will be described in greater detail below with reference to the accompanying drawings FIG. 1 is a perspective view illustrating an example adapter according to an embodiment of the disclosure. FIG. 2 is a diagram illustrating a state in which a plug is separated from a body to allow a plug terminal to be directed to a first direction, in the example adapter according to an embodiment of the disclosure. FIG. 3 is a diagram illustrating a state in which the plug is separated from the body to allow the plug terminal to be directed in a second direction, in the example adapter according to an embodiment of the disclosure. FIG. 4 is a diagram illustrating a state in which the plug is coupled to the body to allow the plug terminal to be directed in the second direction, in the example adapter according to an embodiment of the disclosure. FIG. 5 is a diagram illustrating the plug of the example adapter according to an embodiment of the disclosure.

As illustrated in FIGS. 1, 2, 3, 4 and 5, an adapter 1 according to an embodiment of the disclosure may include a body 10 and a plug 100 removably coupled to the body 10.

The body 10 may, for example, have a substantially rectangular parallelepiped shape. The plug 100 may be coupled to the body 10 such a way that the plug 100 is disposed in an edge of the body 10 when the plug 100 is coupled to the body 10. The plug 100 may be coupled to the body 10 such a way that the plug 100 is placed in a corner the body 10. However, the position of the plug 100 is not limited thereto.

The body 10 may include an adapter pin 11 (see, e.g., FIGS. 2 and 3) electrically connected to the plug 100 and a connector 12 placed at one side of the body 10 and connected to an electronic device (not show). The adapter pins 11 may be provided in a pair, which are separated from each other.

The pair of adapter pins 11 may include a live terminal and a neutral terminal. The live and neutral terminals may, for example, correspond to polarities in alternating current (AC), such as positive and negative terminals of direct current (DC).

For example, when micro-current leakage occurs in a groundless plug, or when noise is generated in an audio device, those problems may be addressed by turning the plug toward the opposite direction to a power outlet, which is related to the polarity of the live and neutral terminals.

The plug 100 may include a plug body 110 and a plug terminal 120 provided on the plug body 110 to be connected to a power outlet (not shown). The plug terminals 120 may be provided in a pair, which are separated from each other.

Although the plug terminal 120 according to an embodiment of the disclosure is illustrated as a 110V plug terminal, the disclosure is not limited thereto. For example, the plug terminal 120 may include a 220V plug terminal.

The plug terminal 120 may be electrically connected to a printed circuit board (not shown) inside the plug body 110.

The body 10 may include a mounting portion 20 to which the plug 100 is mounted. The mounting portion 20 may be provided at the edge of the body 10. The mounting portion 20 may be provided at an edge of the body 10, but the disclosure is not limited thereto.

The mounting portion 20 may include a first mounting portion 21 in which the adapter pin 11 is placed and a second mounting portion 22 extending from the first mounting portion 21 in a direction different from the first mounting portion 21.

The first mounting portion 21 may be directed in a second direction B and the second mounting portion 22 may be directed in a first direction A.

The first direction A and the second direction B may, for example, be perpendicular to each other, but the disclosure is not limited thereto. Therefore, the first direction A and the second direction B may vary according to the shape of the body 10.

The plug 100 may include a first plug body 111 in which the plug terminal 120 is placed and a second plug body 112 extending from the first plug body 111 in a direction different from the first plug body 111.

The first plug body 111 and the second plug body 112 may, for example, be perpendicular to each other, but the disclosure is not limited thereto. Therefore, the first plug body 111 and the second plug body 112 may be bent at various angles based on the angle between the first mounting portion 21 and the second mounting portion 22.

The plug 100 may be removably coupled to the mounting portion 20 so that the plug terminal 120 is positioned at either the first mounting portion 21 or the second mounting portion 22.

For example, because the plug 100 according to an embodiment of the disclosure is rotated and coupled to the mounting portion 20, the plug terminal 120 of the plug 100 coupled to the body 10 may be positioned to be directed to either the first direction A or the second direction B.

The adapter pin 11 may be provided only in the first mounting portion 21. For example, the adapter pin 11 may be not provided in the second mounting portion 22, and thus the single adapter pin 11 corresponding to the single pair of adapter pins 11 may be provided.

The adapter 1 according to an embodiment of the disclosure has a structure in which the plug 100 is selectively inserted into the body 10 to allow the plug terminal 12 to be directed to either the first direction A or the second direction B, but the adapter pin 11 connected to the plug 100 may be provided only in the first mounting portion 21 and thus the single adapter pin 11 may be provided.

Therefore, the internal structure of the body 10 may be simplified, the body 10 may be downsized, and the number of the adapter pin 11 may be reduced. Accordingly, the manufacturing cost of the adapter 1 may be reduced.

In a case where two pairs of adapter pins are arranged in the body 10 to implement a parallel structure in a conventional manner, four wires extending by being connected to the adapter pin in the body may be interlinked with each other, thereby causing conduction noise.

For example, in the adapter 1 according to an embodiment of the disclosure, a parallel structure is arranged in the plug 100, and a pair of adapter pins 11 is arranged only in the body 10. Therefore, it is possible to miniaturize (e.g., reduce a size of) the body 10, and it is possible to separate the live terminal from the neutral terminal by a certain distance, thereby improving Electro Magnetic Interference (EMI) and relatively securing safety in the case of, for example, a lightning surge. Lightning surge corresponding to a lightning strike wave may refer, for example, to an abnormal high voltage that enters from a transmission line to an electrical substation and is generated by lightning stroke.

The plug 100 may be mounted on the mounting portion 20 such a way that the edge of the body 10 is positioned between the first plug body 111 and the second plug body 112. However, the position of the plug 100 is not limited thereto.

The plug 100 may include an insertion portion 113 formed in the plug body 110 to allow the adapter pin 11 to pass therethrough. The insertion portion 113 may have a size corresponding to the adapter pin 11 and may be provided in a pair.

The insertion portion 113 may include a first insertion portion 114 formed in the first plug body 111 and a second insertion portion 115 formed in the second plug body 112.

The first insertion portion 114 may be provided on one side of the first plug body 111 and the second insertion portion 115 may be provided on the second plug body 111 extending from the other side of the first plug body 111.

For example, when the plug 100 is rotated and selectively inserted into the body 10 to allow the plug terminal 120 to be directed to either the first direction A or the second direction B, but the adapter pin 11 connected to the plug 100 may be provided only in the first mounting portion 21. Therefore, one surface of the plug body 110 on which the first insertion portion 114 is arranged may be directed to a direction different from the other surface of the plug body 110 on which the second insertion portion 115 is arranged.

For example, based on the drawings, the first insertion portion 114 may be provided on the upper surface of the first plug body 111, and the second insertion portion 115 may be provided on the lower surface of the second plug body 112.

Therefore, when the plug terminal 120 is arranged in the second mounting portion 22 to be directed to the first direction A, the first insertion portion 114 provided in the first plug body 111 may be exposed to the upper side of the adapter 1.

In the same manner, when the plug terminal 120 is arranged in the first mounting portion 21 to be directed to the second direction B, the second insertion portion 115 provided in the second plug body 112 may be exposed to the upper side of the adapter 1.

The sizes of the first insertion portion 114 and the second insertion portion 115 exposed to the upper portion of the adapter 1 may, for example, be designed to satisfy finger probe test to comply with a safety standard.

For example, the sizes of the first insertion portion 114 and the second insertion portion 115 may be designed to satisfy the finger probe test to prevent and/or reduce an accident that occurs when a user carelessly inserts his or her finger into the first insertion portion 114 or the second insertion portion 115 exposed on the upper portion.

The mounting portion 20 may include a mounting surface 23 from which the adapter pin 11 protrudes, and a support surface 24 bent (e.g., extending) from the mounting surface 23 to support the plug 100.

The mounting surface 23 may include a pinhole 26 (refer to FIG. 8) configured to allow the adapter pin 11 to pass through. The adapter pin 11 may be inserted into the insertion portion 113 of the plug body 110 by passing through the pinhole 26.

The pinhole 26 through which the adapter pin 11 protrudes may be formed on the mounting surface 23 of the first mounting portion 21, but the pinhole 26 may not be formed on the mounting surface 23 of the second mounting portion 22 because the adapter pin 11 is not provided on the mounting surface 23 of the mounting portion 22.

The support surface 24 may support an inner surface of the plug body 110.

The mounting portion 20 may include a guide surface 25 bent from the mounting surface 23 and the support surface 24, and the guide surface 25 on which the guide 30 is provided.

The guide 30 may include a first guide 31 provided on the body 10 to guide the plug 100 when being coupled to the body 10, and a second guide 32 provided on the plug 100 to be removably coupled to the first guide 31. A detailed structure of the guide 30 will be described in greater detail below.

The adapter 1 may include a fixing portion 40 configured to detachably fix the plug 100 to the body 10. The fixing portion 40 may include a first fixing portion 41 provided on the body 10 and a second fixing portion 42 provided on the plug 100 to be coupled to the first fixing portion 41.

The first fixing portion 41 may be provided on the first mounting portion 21. The first fixing portion 41 may be arranged between the pair of adapter pins 11. The first fixing portion 41 may be arranged on the mounting surface 23 and the support surface 24.

However, the position of the first fixing portion 41 is not limited thereto. Therefore, the first fixing portion 41 may be arranged at various positions as long as the first fixing portion 41 is inserted into the second fixing portion 42 so as to fix the plug 100 to the body 10.

For example, the first fixing portion 41 may be provided in the second mounting portion 22.

The second fixing portion 42 may be provided on the inner surface of the plug body 110. However, the position of the second fixing portion 42 is not limited thereto. Therefore, the second fixing portion 42 may be arranged at various positions as long as the second fixing portion 42 is coupled to the first fixing portion 41 so as to fix the plug 100 to the body 10.

The first fixing portion 41 may include a button 43 provided on the body 10 and a locking portion 44 coupled to and separated from the second fixing portion 42 by being moved by the button 43.

The button 43 and the locking portion 44 may be formed integrally. The button 43 may be provided on one side of the body 10 bent from the mounting surface 23. The locking portion 44 is bent from the button 43 and provided on the mounting surface 23 and the support surface 24, but the position of the button 43 and the locking portion 44 is not limited thereto.

The locking portion 44 may protrude from the support surface 24. The second fixing portion 42 may include a locking groove 45 into which the locking portion 44 is inserted. The locking groove 45 may be larger than the locking portion 44 so that the locking portion 44 is inserted. The locking portion 44 may be inserted into the locking groove 45 and coupled to the locking groove 45.

The locking portion 44 may be provided in either the first mounting portion 21 or the second mounting portion 22 and thus a single locking portion 44 may be provided. The locking groove 45 may be provided in the first plug body 111 and the second plug body 112 respectively, and thus two locking grooves 45 may be provided.

The locking groove 45 may be provided on the inner surface of the first plug body 111 and the inner surface of the second plug body 112, respectively.

For example, the plug 100 may be rotated and selectively inserted into the body 10 to allow the plug terminal 120 to be directed to either the first direction A or the second direction B, but the single locking portion 44 connected to the locking groove 45 is provided in the first mounting portion 21. Therefore, the two locking grooves 45 may be formed on different positions on the plug body 110.

For example, one of the two locking grooves 45 may be provided on the upper portion of the inner surface of the first plug body 111, and the other of the two locking grooves 45 may be provided on the lower portion of the inner surface of the second plug body 112 as illustrated in the drawings.

Figure 6:
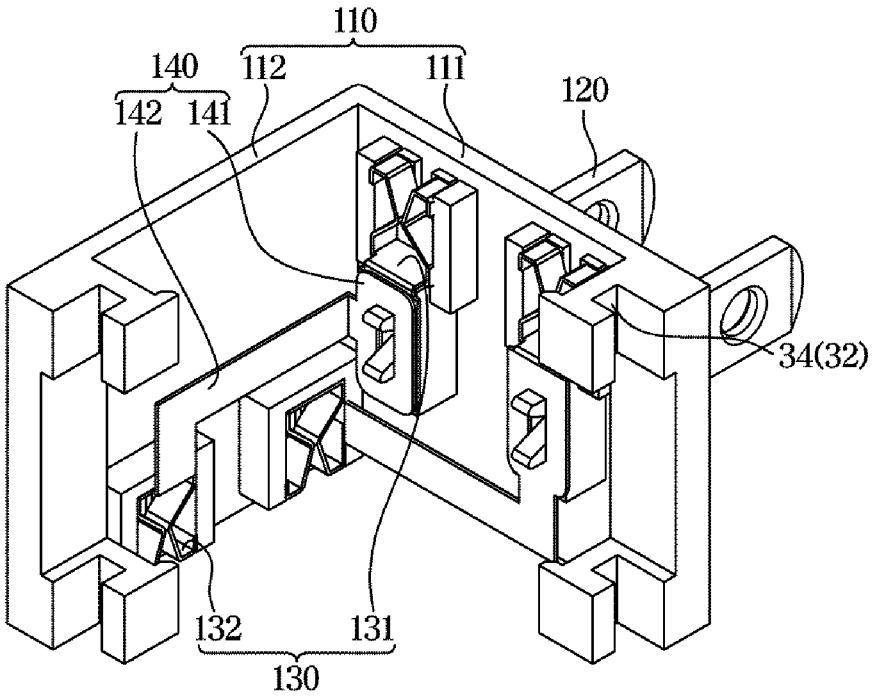
FIG. 6 is a diagram illustrating an internal structure of the example plug according to an embodiment of the disclosure.
Figure 7:
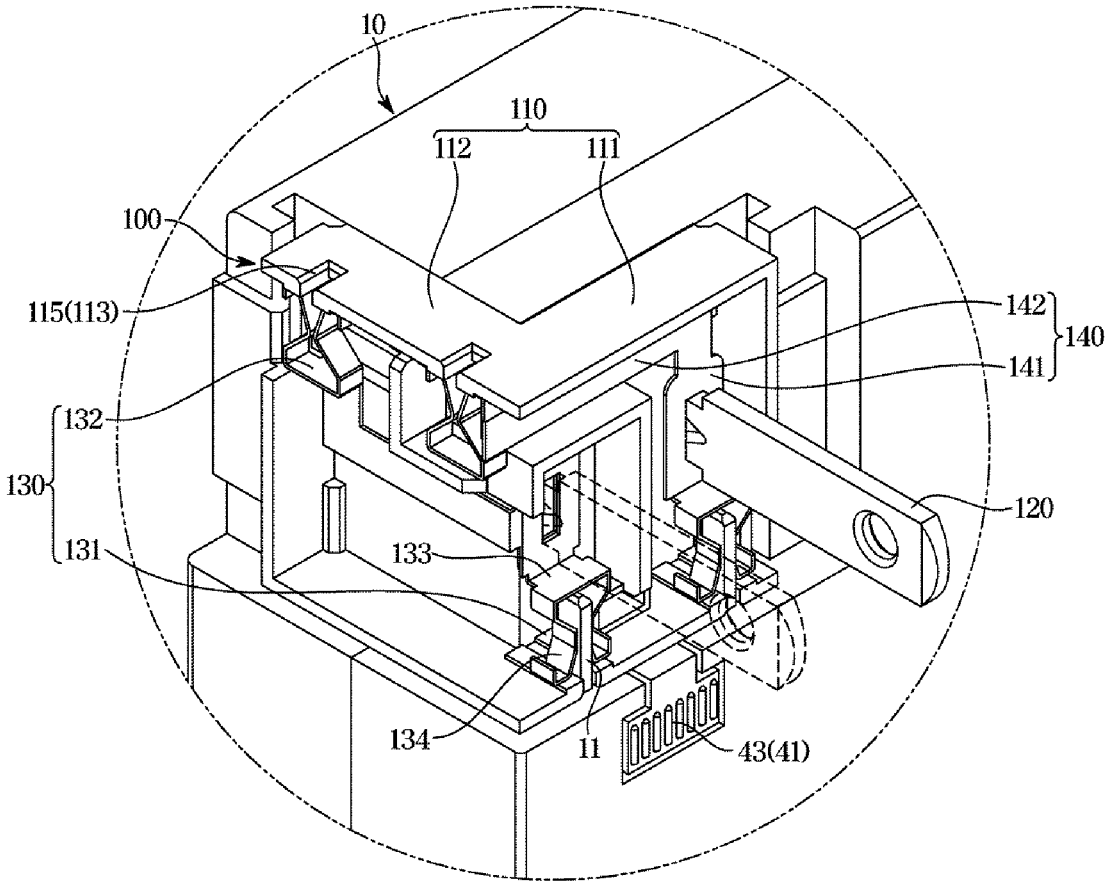
FIG. 7 is a diagram illustrating a state in which an adapter pin is elastically coupled to a socket, in the adapter according to an embodiment of the disclosure.
Figure 8:
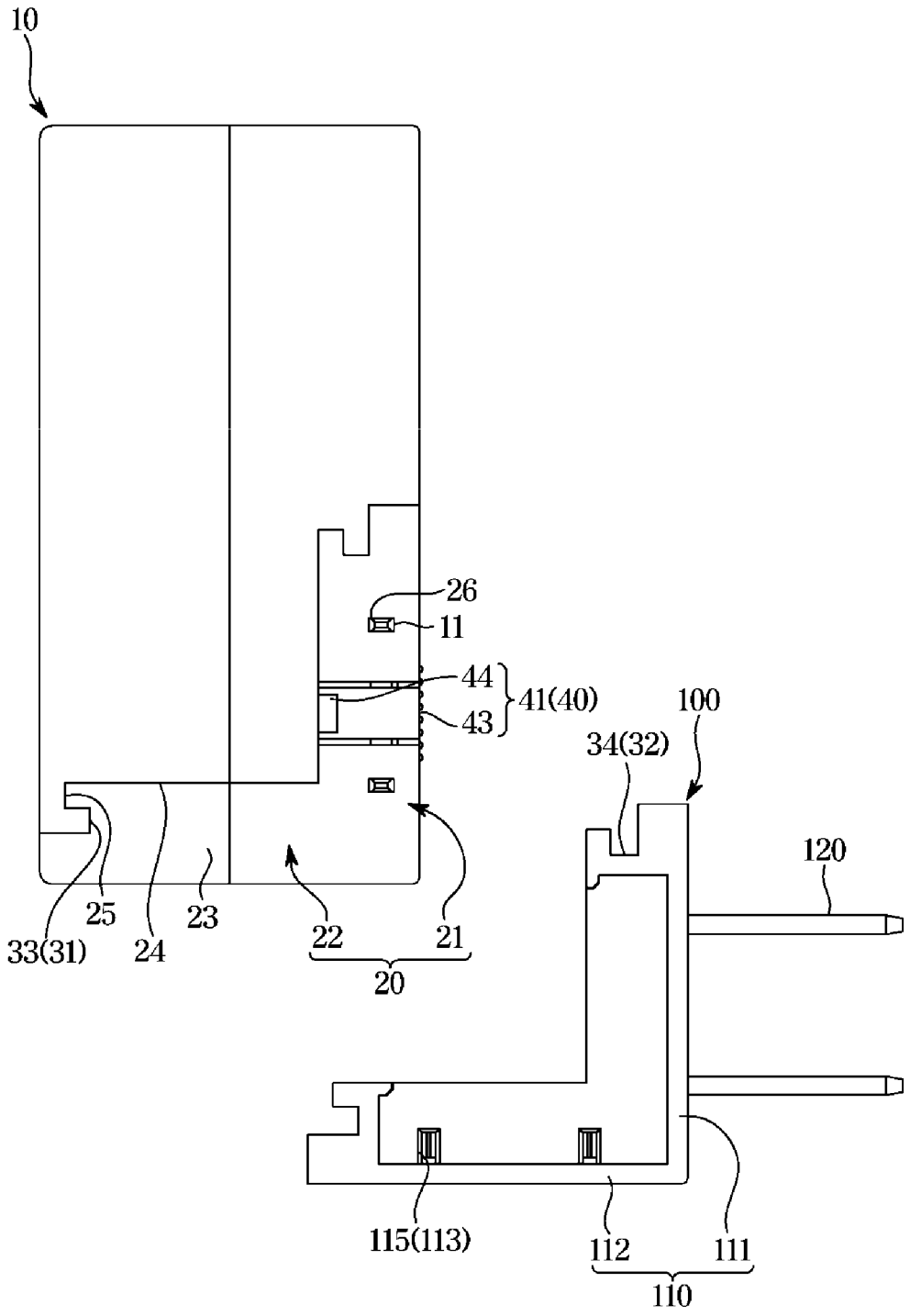
FIG. 8 is a cross-sectional view illustrating an example guide in the adapter according to an embodiment of the disclosure.

FIG. 6 is a diagram illustrating an internal structure of the example plug in the example adapter according to an embodiment of the disclosure. FIG. 7 is a diagram illustrating a state in which an adapter pin is elastically coupled to a socket, in the example adapter according to an embodiment of the disclosure. FIG. 8 is a cross-sectional view illustrating an example guide in the example adapter according to an embodiment of the disclosure.

As illustrated FIGS. 6, 7 and 8, the plug 100 may include a socket 130 provided in the plug body 110 to allow the adapter pin 11 to be inserted thereinto. The socket 130 may be provided in a pair to correspond to the pair of the adapter pins 11.

The socket 130 may include a first socket 131 provided on one side of the first plug body 111 and a second socket 132 provided on the second plug body 112 extending from the other side of the first plug body 111.

For example, the plug 100 may be rotated and selectively coupled to the body 10 to allow the plug terminal 120 to be directed to either the first direction A (refer to FIG. 4) or the second direction B (refer to FIG. 4), but the adapter pin 11 connected to the plug 100 is provided on the first mounting surface 21 (refer to FIG. 3) and thus the single adapter pin 11 is provided. Therefore, a position where the first socket 131 is arranged in the first plug body 111 may be different from a position where the second socket 132 is arranged in the second plug body 112.

For example, based on the drawings, the first socket 131 may be provided in the lower portion of the inside of the first plug body 111, and the second socket 132 may be provided in the upper portion of the inside of the second plug body 112.

The adapter pin 11 may penetrate the pin hole 26 provided in the mounting surface 23 (refer to FIG. 3) and may be inserted into the socket 130 through the insertion portion 113 provided in the plug body 110, thereby being electrically connected to the socket 130.

For example, the insertion portion 113 may include a first insertion portion 114 provided on the first plug body 111 to allow the adapter pin 11 to penetrate and to be inserted into the first socket 131, and a second insertion portion 115 provided on the second plug body 112 to allow the adapter pin 11 to penetrate and to be inserted into the second socket 132.

In order to electrically connect the first socket 131 to the second socket 132, the plug 100 may include a connecting member 140 arranged between the first socket 131 and the second socket 132 to connect the first socket 131 to the second socket 132.

The connecting member 140 may include a first connecting member 141 connected to the plug terminal 120 and a second connecting member 142 extending from the first connecting member 141, and may comprise a conductive material.

The first socket 131 may be connected to the first connecting member 141 and the second socket 132 may be connected to the second connecting member 142. The first socket 131 may be connected in parallel with the second socket 132 through the connecting member 140.

For example, the plug 100 may include the connecting member 140 configured to connect the plug terminal 120 to the adapter pin 11 so that the plug terminal 120 is placed on the second mounting surface 22 (refer to FIG. 3) and electrically connected to the adapter pin 11.

The socket 130 may include a connecting portion 133 coupled to the connecting member 140 and an elastic portion 134 extending from the connecting portion 133 and configured to elastically fix the adapter pin 11.

The plug 100 may be rotated and selectively coupled to the body 10 to allow the plug terminal 120 to be directed to either the first direction A or the second direction B, but the first socket 131 may be connected in parallel with the second socket 132 through the connecting member 140 so that the adapter pin 11 connected to the plug 100 is provided on the first mounting surface 21 (refer to FIG. 3) and thus the single adapter pin 11 is provided.

As for the adapter 1 according to an embodiment of the disclosure, in order to simplify the internal structure of the body 10, which has a complicated internal structure due to a relatively large number of internal components relative to the plug 100, the single adapter pin 11 installed in the body 10 may be provided, but the first socket 131 may be connected in parallel with the second socket 132 of the plug 100 through the connecting member 140, and thus the plug 100 may be rotated and selectively coupled to the body 10 to allow the plug terminal 120 to be directed to either the first direction A or the second direction B.

The elastic portions 134 may be provided in a pair to face each other, but the disclosure is not limited thereto. Therefore, the elastic portion 134 may include various structures as long as the elastic portion 134 elastically fixes the adapter pin 11.

Because the socket 130 according to an embodiment of the disclosure includes the elastic portion 134, the socket 130 may be stably fixed to the adapter pin 11 using only the elasticity of the socket 130 without an additional fixing structure upon being coupled to the adapter pin 11.

The guide 30 may include the first guide 31 provided on the body 10 to guide the plug 100 coupled to the body 10, and the second guide 32 provided on the plug 100 to be removably coupled to the first guide 31.

The first guide 31 may be arranged at one end portion of the first mounting portion 21 and the second mounting portion 22. The second guide 32 may be arranged at one end portion of the first plug body 111 and the second plug body 112.

The first guide 31 may include a guide protrusion 33 protruding from the guide surface 25. The second guide 32 may include a guide groove 34 provided at one end of the plug 100 to be coupled to the guide protrusion 33. The guide protrusion 33 and the guide groove 34 may be coupled to each other in a sliding manner However, the disclosure is not limited thereto, the first guide portion 31 and the second guide portion 32 may have a variety of positions, number and shapes as long as the first guide portion 31 and the second guide portion 32 guides the plug 100 to be coupled to the body 10.

For example, the first guide portion 31 may include a guide groove, and the second guide portion 32 may include a guide protrusion slidably coupled to the guide groove.

Figure 9:
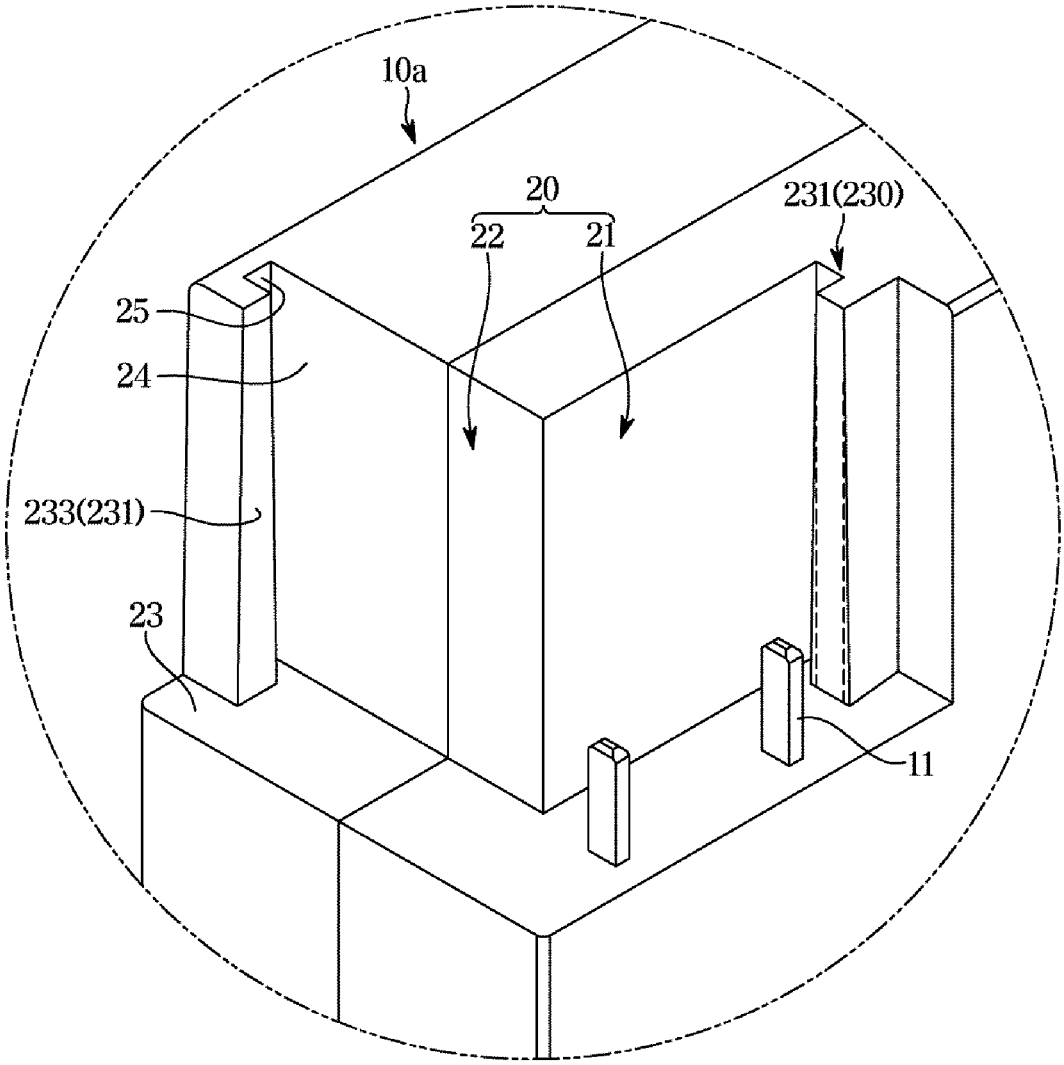
FIG. 9 is a diagram illustrating an example guide in an adapter according to another embodiment of the disclosure.

FIG. 9 is a diagram illustrating an example guide in an example adapter according to another embodiment of the disclosure. A body 10*a* according to another embodiment of the disclosure may have substantially the same configuration as the body 10 (refer to FIG. 8) according to an embodiment of the disclosure, but there may be differences in a structure of a guide 230 and the presence of a fixing portion 40.

Hereinafter the guide 230 according to another embodiment of the disclosure will be described with reference to a difference from the guide 30 according to an embodiment of the disclosure.

As illustrated in FIG. 9, a body 10*a* may include a guide 230 configured to guide the plug 100 (refer to FIG. 8) to allow the plug 100 to be coupled to the body 10*a*.

The guide 230 may include a first guide 231 provided on the body 10*a* to guide the plug 100 coupled to the body 10*a*, and a second guide 32 (refer to FIG. 8) provided on the plug 100 to be removably coupled to the first guide 231.

The first guide 231 may be arranged at one end portion of a first mounting portion 21 and a second mounting portion 22. The second guide 32 may be arranged at one end portion of the first plug body 111 (refer to FIG. 8) and the second plug body 112 (refer to FIG. 8).

The first guide 231 may include a guide protrusion 233 protruding from a guide surface 25. The second guide 32 may include a guide groove 34 (refer to FIG. 8) provided at one end of the plug 100 to be coupled to the guide protrusion 233. The guide protrusion 233 and the guide groove 34 may be inserted and coupled to each other in a sliding manner.

The guide protrusion 233 may have a width that becomes larger toward the mounting surface 23 so that the guide protrusion 233 is fixed to the guide groove 34. The guide protrusion 233 may have an inclination. The guide protrusion 233 and the guide groove 34 may include a wedge structure.

For example, a width of an upper portion of the guide protrusion 233 may be the same as a width of an upper portion of the guide groove 34. However, the width of the guide groove 34 may be not changed although the guide groove 34 becomes closer to the mounting surface 23, and the width of the guide protrusion 233 may be increased as the guide protrusion 233 becomes closer to the mounting surface 23. Therefore, the guide protrusion 233 may be inserted and coupled to the guide groove 34 as the guide protrusion 233 becomes closer to the mounting surface 23.

Because the guide protrusion 233 is guided and inserted-coupled to the guide groove 34 in the sliding manner as the guide protrusion 233 becomes closer to the mounting surface 23, the body 10*a* according to another embodiment of the disclosure may not require an additional fixing portion 40 (refer to FIG. 8) configured to fix the plug 100 to the body 10*a*.

Therefore, it is possible to guide and fix the plug 100 to the body 10*a* by using the guide 230 having the guide protrusion 233 and the guide groove 34, thereby simplifying the structure.

Figure 10:
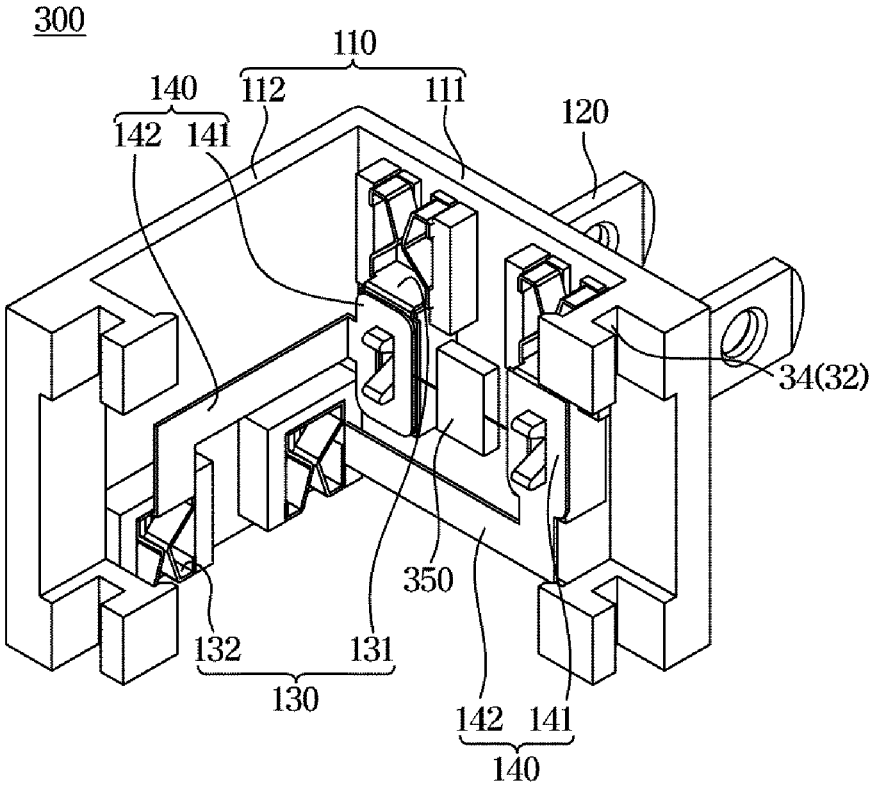
FIG. 10 is a diagram illustrating an example noise filter arranged in a plug according to another embodiment of the disclosure.

FIG. 10 is a diagram illustrating an example a noise filter arranged in a plug in an adapter according to another embodiment of the disclosure.

A plug 300 according to another embodiment of the disclosure may have substantially the same configuration as the plug 100 (refer to FIG. 6) according to an embodiment of the disclosure, but there may be difference in the presence of a noise filter 350.

Hereinafter a plug 300 according to another embodiment of the disclosure will be described with respect to a difference from the plug 100 according to an embodiment of the disclosure.

As illustrated in FIG. 10, the plug 300 may include a socket 130 provided in a plug body 110 to allow the adapter pin 11 (refer to FIG. 3) to be inserted thereinto. The socket 130 may be provided in a pair to correspond to the pair of the adapter pins 11.

The socket 130 may include a first socket 131 provided on one side of a first plug body 111 and a second socket 132 provided on a second plug body 112 extending from the other side of the first plug body 111.

In order to electrically connect the first socket 131 to the second socket 132, the plug 300 may include a connecting member 140 arranged between the first socket 131 and the second socket 132 to connect the first socket 131 to the second socket 132.

The connecting member 140 may include a first connecting member 141 connected to the plug terminal 120 and a second connecting member 142 extending from the first connecting member 141.

The first socket 131 may be connected to the first connecting member 141 and the second socket 132 may be connected to the second connecting member 142. The first socket 131 may be connected in parallel with the second socket 132 through the connecting member 140.

The plug 300 may include a noise filter 350 connected to between the connecting members 140 to prevent and/or reduce noise, which may be generated in an electronic device (not shown) connected to the adapter 1 (refer to FIG. 3), from being conducted to the outside.

The adapter 1 may require an Electro Magnetic Interference (EMI) filter design so that the conduction noise of the electronic device does not affect the surrounding electronics. As the noise filter 350 is closer to the plug terminal 120, the effect can be increased.

EMI may refer, for example, to a state in which other electronic devices are disturbed by noise generated in the electronic device, and can also be referred to as electromagnetic interference.

The plug 300 according to another embodiment of the disclosure may effectively reduce noise conduction by placing the noise filter 350 between a pair of connecting members 141 connected to the plug terminal 120. The noise filter 350 may, for example, include an X-capacitor having a low depth.

However, the disclosure is not limited thereto. The noise filter 350 may be arranged at various positions and have a variety of structures as long as the noise filter 350 prevents and/or reduces noise, which is generated in an electronic device connected to the adapter 1, from being conducted to the outside.

Figure 11:
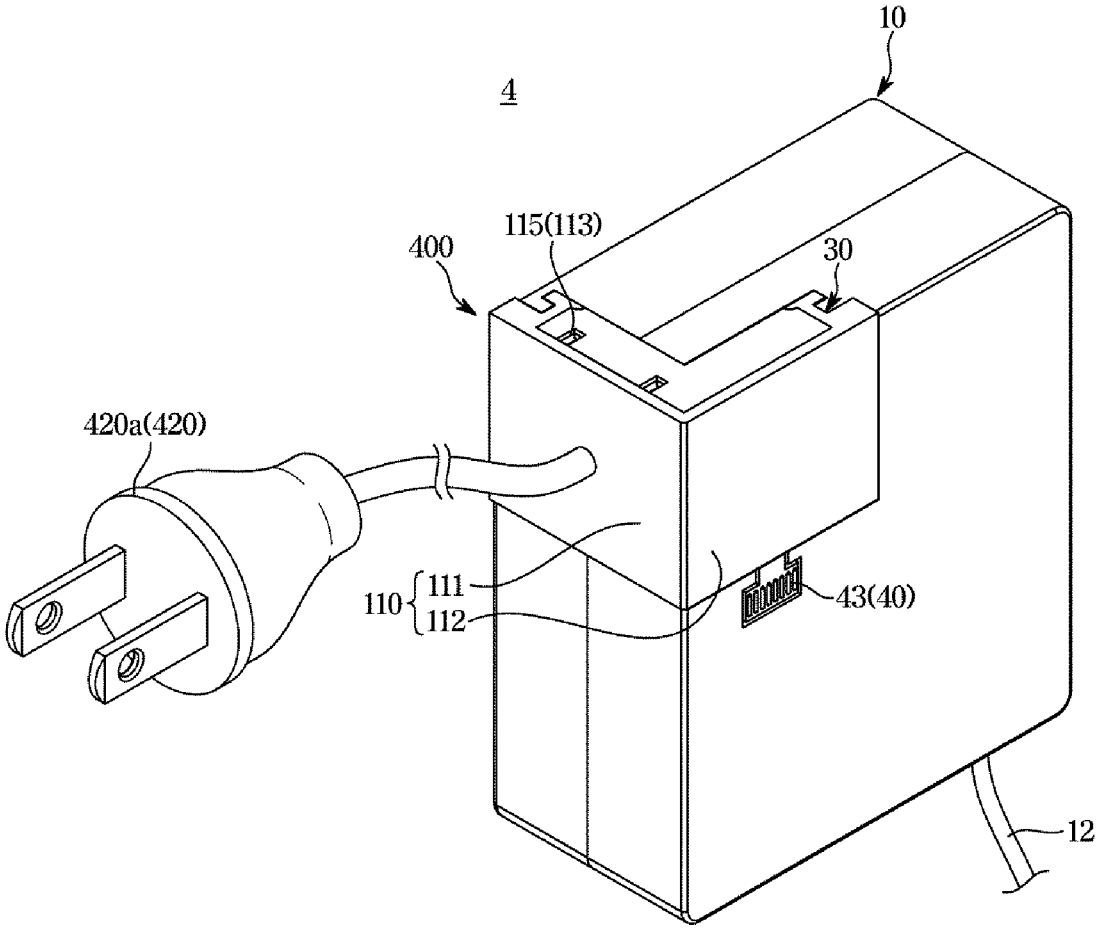
FIG. 11 is a diagram illustrating an example plug having a power code in an adapter according to another embodiment of the disclosure.

FIG. 11 is a diagram illustrating an example plug having a power code in an adapter according to another embodiment of the disclosure.

A plug 400 according to another embodiment of the disclosure may have substantially the same configuration as the plug 100 (refer to FIG. 1) according to an embodiment of the disclosure, but there may be differences in the structure of a plug terminal 420.

Hereinafter the plug 400 according to another embodiment of the disclosure will be described with respect to a difference from the plug 100 according to an embodiment of the disclosure.

As illustrated in FIG. 11, an adapter 4 according to another embodiment of the disclosure may include a body 10 and a plug 400 removably coupled to the body 10. The body 10 may include a connector 12 placed at one side of the body 10 and connected to an electronic device (not show).

The plug 400 may include a plug body 110 and a plug terminal 420 provided on the plug body 110 to be connected to a power outlet (not shown).

The plug 400 may include a first plug body 111 in which the plug terminal 420 is placed and a second plug body 112 extending from the first plug body 111 to be directed to a direction different from the first plug body 111.

The plug terminal 420 may include a power cord 420*a* provided in the plug body 110.

The plug 400 according to another embodiment of the disclosure may include the plug terminal 420 having the power cord 420*a*, thereby ensuring ease of use.

As is apparent from the above description, by including a plug removably coupled to in a body in a plurality of directions, it is possible to improve the usability of an adapter by reducing interference that may occur with other adjacent adapters or plugs when the adapter is inserted into a power outlet.

Because a plurality of sockets provided on a plug in a plurality of directions are connected in parallel with each other, only one adapter pin of a body may be used and thus the adapter may be designed easily.

By including a guide and a fixing portion having a simple structure, a body and a plug may be easily coupled to each other and separated from each other and thus the convenience of the user may be increased.

Although various example embodiments of the present disclosure have been illustrated and described, it would be appreciated by those skilled in the art that changes may be made in these embodiments without departing from the principles and spirit of the disclosure, the scope of which may be defined, for example, in the claims and their equivalents.

What is claimed is:

1. An adapter comprising:

an adapter body comprising an adapter pin;

a mounting recess provided in the adapter body and comprising a first mounting recess provided on one side of the adapter body on which the adapter pin is disposed, and a second mounting recess provided on another side of the adapter body on which the adapter pica is not disposed; and a plug configured to be removably coupled to the first mounting recess and the second mounting recess, wherein a plug terminal provided on one side surface of the plug is configured to be electrically connected to the adapter pin provided on the one side of the first mounting recess regardless of an orientation of the plug with respect to the mounting recess, wherein the plug is mounted to the first mounting recess and the second mounting recess such that the plug terminal is configured to be disposed on one of the first mounting recess oriented in a first direction and the second mounting recess oriented in a second direction different from the first direction.

2. The adapter of claim 1, wherein the plug further comprises a plug body comprising a first plug body on which the plug terminal is disposed, and a second plug body extending from the first plug body in a direction different from a direction in which the first plug body extends.

3. The adapter of claim 2, further co sing:

a fixing portion comprising a first fixing portion provided in the adapter body and configured to removably fix the plug to the adapter body, and a second fixing portion provided in the plug and configured to be coupled to the first fixing portion.

4. The adapter of claim 3, wherein the first fixing portion comprises a button disposed in the adapter body and a locking portion configured to be coupled to aid separated from the second fixing portion by being moved by the button, the second fixing portion comprising a locking groove into which the locking portion is insertable.

5. The adapter of claim 4, wherein the locking portion is provided in one of the first mounting recess and the second mounting recess, and the locking groove is provided in the first plug body and the second plug body, respectively.

6. The adapter of claim 2, wherein the plug comprises a socket comprising a first socket provided on one side of the first plug body and configured to allow the adapter pin to be inserted into the first socket, and a second socket disposed in the second plug body.

7. The adapter of claim 6, wherein the plug body comprises an insertion portion comprising a first insertion portion provided in the first plug body and configured to allow the adapter pin to pass through the first insertion portion and to be inserted into the first socket, and a second insertion portion provided in the second plug body and configured to allow the adapter pin to pass through the second insertion portion and to be inserted into the second socket.

8. The adapter of claim 6, wherein the first socket is electrically connected to the second socket through a connecting member.

9. The adapter of claim 8, wherein the socket comprises a connecting portion coupled to the connecting member and an elastic portion extending from the connecting portion and configured to elastically fix the adapter pin.

10. The adapter of claim 8, wherein the connecting member comprises a pair of connecting members, and the plug further comprises a noise filter connected between the pair of connecting members and configured to reduce noise generated in an electronic device connected to the adapter from being conducted to the outside.

11. The adapter of claim 1, further comprising:

a guide comprising a first guide provided in the adapter body and configured to guide the plug to be coupled to the adapter body, and a second guide provided in the plug and configured to be removably coupled to the first guide.

12. The adapter of claim 11, wherein the mounting recess further comprises a mounting surface comprising a pinhole through which the adapter pin passes; a support surface bent from the mounting surface and configured to support the plug; and a guide surface on which the guide is provided, the guide surface being bent from the mounting surface and the support surface.

13. The adapter of claim 12, wherein the first guide comprises a guide protrusion protruding from the guide surface, and the second guide comprises a guide groove provided at one end of the plug and configured to be coupled to the guide protrusion.

14. The adapter of claim 13, wherein the guide protrusion has a width that increases along a length of the guide protrusion toward the mounting surface.

15. An adapter comprising:

an adapter body comprising an adapter pin;

a mounting recess provided in the adapter body and comprising a first mounting recess on which the adapter pin is disposed, and a second mounting recess extending from the first mounting recess in a direction different from a direction in which the first mounting recess extends;

a plug configured to be removably coupled to the mounting recess and configured to allow a plug terminal to be disposed on one of the first mounting recess and the second mounting recess;

a fixing portion comprising a first fixing portion provided in the adapter body and configured to fix the plug to the adapter body, and a second fixing portion provided in the plug and configured to be coupled to the first fixing portion; and a guide comprising a first guide provided in the adapter body and configured to guide the plug to be coupled to the adapter body, and a second guide provided in the plug and configured to be coupled to the first guide in a sliding manner.

16. The adapter of claim 15, wherein the plug comprises a plug body comprising a first plug body on which the plug terminal is disposed, and a second plug body extending from the first plug body in a direction different from a direction in which the first plug body extends, and the plug is mounted to the mounting recess of the adapter body such that a corner of the adapter body is arranged between the first plug body and the second plug body.

17. An adapter comprising:

an adapter body comprising an adapter pin;

a plug configured to be removably coupled to the adapter body, and comprising a plug body comprising a first plug body on which a plug terminal is disposed, and a second plug body extending from the first plug body in a direction different from a direction in which the first plug body extends, wherein the plug terminal comprises a power cord provided in the plug body; and a mounting recess provided in the adapter body, and comprising a first mounting recess on which the adapter pin is disposed, and a second mounting recess extending from the first mounting portion in a direction different from a direction in which the first mounting recess extends, wherein the plug further comprises a socket into which the adapter pin is to be inserted so that the plug terminal is disposed on one of the first mounting recess and the second mounting recess so as to be electrically connected to the adapter pin, the socket comprising a first socket provided in the first plug body and a second socket provided in the second plug body.

* * * * *